US005768916A

United States Patent [19]

Borer

[11] Patent Number: 5,768,916

[45] Date of Patent: Jun. 23, 1998

[54] WARP KNITTING MACHINE

[75] Inventor: Silvan Borer, Uitikon, Switzerland

[73] Assignee: Textilma AG, Switzerland

[21] Appl. No.: 725,568

[22] Filed: Oct. 3, 1996

[30] Foreign Application Priority Data

Oct. 11, 1995 [CH] Switzerland ..... 2876/95

[51] Int. Cl.[6] ..... D04B 27/24

[52] U.S. Cl. ..... 66/214; 66/204; 66/207

[58] Field of Search ..... 66/204, 207, 214

[56] References Cited

U.S. PATENT DOCUMENTS

| | | | |
|---|---|---|---|
| 3,074,259 | 1/1963 | Bassist . | |
| 3,303,670 | 2/1967 | Bassist | 66/214 X |
| 4,051,698 | 10/1977 | Leonhardt | 66/214 X |
| 4,549,414 | 10/1985 | Zorini et al. | 66/207 X |
| 5,241,842 | 9/1993 | Hagel | 66/204 |
| 5,390,513 | 2/1995 | Hagel et al. | 66/214 X |
| 5,533,366 | 7/1996 | Mista et al. | 66/207 X |
| 5,544,500 | 8/1996 | Speich . | |

FOREIGN PATENT DOCUMENTS

| | | | |
|---|---|---|---|
| 0511580 | 4/1992 | European Pat. Off. . | |
| 2039846 | 4/1984 | Germany | 66/207 |
| 286826 | 2/1991 | Germany | 66/204 |
| WO9423106 | 10/1994 | WIPO . | |

*Primary Examiner*—John J. Calvert
*Attorney, Agent, or Firm*—George Pappas

[57] ABSTRACT

A warp knitting machine with at least one knitting needle bar and with at least one guide bar (46) lapping in lengthwise direction with thread guides for the feeding of threads. Incorporated into the guide bar is at least one auxiliary guide bar (72) lapping back and forth in the lengthwise direction of the guide bar with at least one auxiliary thread guide (76), which are driven relatively to one another. This allows for the arrangement of an auxiliary thread guide in an especially simple and space-saving manner.

17 Claims, 1 Drawing Sheet

WARP KNITTING MACHINE

TECHNICAL FIELD

The invention relates to a warp knitting machine with at least one knitting needle bar and at least one guide bar shiftable at least in lengthwise direction with thread guides for the feeding of threads to the knitting needle courses.

STATE OF THE ART

Warp knitting machines of the type mentioned at the outset in the Technical Field are well known, for example, from WO 94/23106. In this type of knitting machine, for each thread or each thread group which is to be laid independently from other threads a guide bar of its own is required, so that a large number of guide bars arranged adjacently and one over another are required, whereby there is yielded not only a complicated, but also a difficultly accessible construction.

SUMMARY OF THE INVENTION

A problem solved by the invention is further to improve a warp knitting machine of the type mentioned hereinabove.

The problem is solved according to the invention by providing a warp knitting machine, with at least one knitting needle bar and at least one guide bar lapping in lengthwise direction with thread guides for the feeding of threads to the knitting needle bars, and further wherein the guide bar has at least one auxiliary guide bar lapping back and forth in the lengthwise direction of the guide bar with at least one auxiliary thread guide which is driven relatively to the guide bar. Through the arrangement of an auxiliary guide bar on a guide bar there is yielded an especially space-saving formation and it is possible for a lap or lapping movement of its own to be carried out independently from the laps of the main guide bar, without a separate guide bar being necessary for the purpose. Thus, for example, the structure in the border zone of a knitted article can be laid out differently than in the other area of the knitted article to be produced.

Theoretically the auxiliary thread guide can be active in another plane than in that of the thread guide of the main guide bar. Advantageous, however, is a formation so that the auxiliary thread guides and the thread guides lie in one plane and thus act on the same displacement line.

The guide bar can be constructed as a one-side open profile in E- or U-form; especially advantageous, however is a formation of the warp knitting machine, in which the tubular or hollow profile of the guide bar imparts not only a high intrinsic strength, but also the necessary construction space to guide the auxiliary guide bar. Such a guide bar is advantageous especially for coarse knitted articles, for example for relative coarse threads up to 4800 tex. In the working of such coarse threads there are yielded high transverse forces on the guide bars, whereby the cross section is subjected to high bending moments in transverse direction, which, however, can be dealt with a tubular profile-type construction of the guide bar. The thread guides themselves can be arranged as tubelets in the tubular profile.

It is especially advantageous if the auxiliary guide bar is bias-tensioned into a base position, so that for the shifting of the auxiliary guide bar only a drive in one direction is needed. This makes possible, in particular a further development so that for the auxiliary guide bar no drive of its own is necessary. It is also possible, however, to equip the auxiliary guide bar with a drive device of its own. There, such a drive can be formed pneumatically, hydraulically or electrically and be active only in one direction if the auxiliary guide bar is biased in base position or in both lapping directions. As electrical drive there can be used either a linear motor or an asynchronous or synchronous motor.

An advantageous formation of the drive of the guide bar, whereby a more individual control of the warp knitting machine is possible. The further development of the warp knitting machine makes it possible to vary the lapping of the guide bar within wide limits.

The guide bar with the auxiliary guide bar is suited for warp knitting machines of the most diverse type, especially, however, for raschel machines and in particular for the production of coarse knitted goods such as nets, mats and the like from correspondingly coarse threads of the above-mentioned type and for the most diverse purposes of use. The thread guides serve there especially for the formation of the warp meshes of the knitted article, for example of a net and of the auxiliary thread guide or guides for special assignments, for example for the patterning and for special construction as for the formation of a border mesh of a knitted article which is independent of the construction within the knitted article.

BRIEF DESCRIPTION OF THE DRAWINGS

Examples of execution of the invention are described in detail in the following with the aid of schematic drawings; here.

DESCRIPTION OF INVENTION

A preferred example of execution of a warp knitting machine according to the invention is a double bar raschel machine, i.e. a warp knitting machine with two needle bars which are arranged in each case to oscillate up and down on oscillating levers (or rocker rods) borne in the machine frame and are driven in a known manner.

To each knitting needle bar there is allocated a partial weft device or a full weft device. The partial weft device has a guide bar and thread guides, which are all lapping over only a section of the working width. The full weft device contains a member reciprocating over the whole working width, with one thread guide for the execution of the full weft.

Above the knitting needle bars there are arranged further guide bars with thread guides to feed warp threads . The guide bars are connected on both sides to two parallel guide bars, borne shiftably in lengthwise direction, i.e. they are borne to slide back and forth in swinging plates, which on their part are fastened to a swingable shaft which is borne in the machine frame and is drivable in a manner not represented in detail. The guide bars are built substantially identical and are described in detail in FIGS. 1 to 3.

Figure 1:
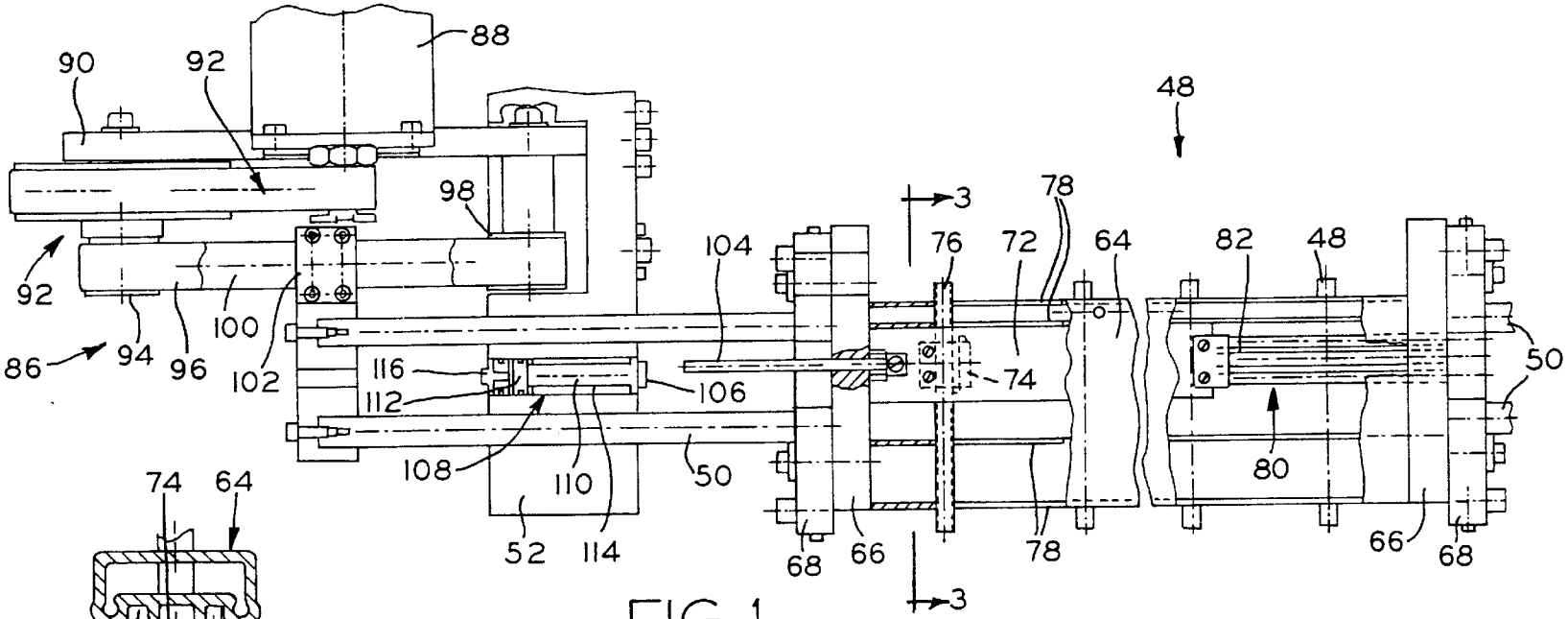
FIG. 1 shows a guide bar of the warp knitting machine of the present invention as viewed toward the broad side and partially sectioned.
Figure 2:
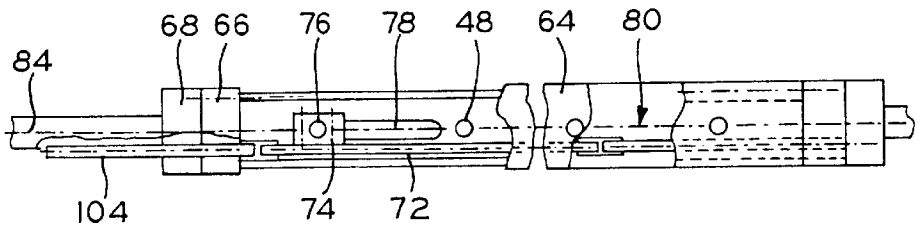
FIG. 2 shows the guide bar of FIG. 1 in plan.
Figure 3:
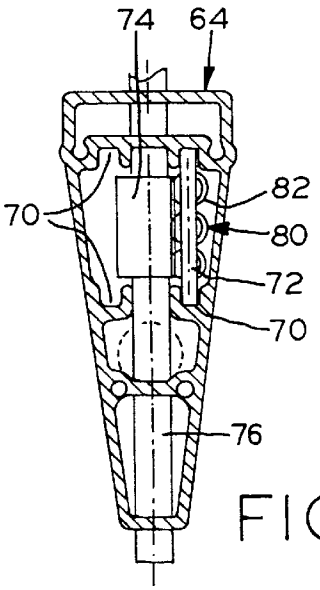
FIG. 3 shows the guide bar of FIG. 1 in the section III—III of FIG. 1 and on a larger scale.

The guide bar 46 represented in FIGS. 1 to 3 has a downward-tapering tubular profile 64 which carries flanges 66 on both ends.

The guide bar 46 represented in FIGS. 3 to 5 has a downward-tapering tubular profile 64 which carries flanges 66 on both ends. To the flanges 66 there is connected in each case a carrier plate 68, to which the guide bars 50 are fastened. In the tubular profile 64 thread guides 48 in the form of continuous tubelets are incorporated. The tubular profile 64 contains on both sides of the central plane guides 70 for the reception of an auxiliary guide bar 72 to which, over a clamping device 74, there is fastened an auxiliary thread guide 76, which is built similar to the thread guides 48, but is shiftable in lengthwise direction relatively to the guide bar 46. For this the tubular profile 64 has corresponding lengthwise slots 78. A spring device 80 with screw springs 82 spans the auxiliary guide bar 72 and therewith the auxiliary thread guide 76 into a base position which corresponds to the stop of the auxiliary guide bar 72 on the left flange 66 of the guide bar 46. In the example shown, only one auxiliary guide bar 72 is present with an auxiliary thread guide 76, which is arranged at the end of the guide bar and serves to form the edge of the knitted article; there may also, however, be several auxiliary thread guides 76 present on the auxiliary guide bar 72 as well as at least one further auxiliary guide bar. The auxiliary thread guide acts on the same displacement line 84 and lies, therefore, preferably in the same plane as the thread guide 48.

The guide bar 46 is driven by a drive 86 of its own, which may, for example, be fluid-actuated or preferably electrically driven. In the present example the drive device 86 has a motor 88 which is connected over a bracket 90 with the swinging plate 52. The motor 88 is connected by a reducing gear 92 in the form of a power belt gear with a drive wheel 94, by which a circulating member 96, for example a power belt, is guided, which runs further over a deflecting roll 98. To a slack 100 of the circulating member 96 the guide bars 50 are connected by means of a clamping device 102 with the circulating member 96, so that reciprocating movement of the motor 88 executes a corresponding oscillating displacement of the guide bar 46 relative to the swinging plate 52. In addition to controlling the motor 88, the amount of the displacement of the guide bar 46 can be varied by changing the reduction ratio of the reducing gear 92.

The auxiliary guide bar 72 is driven by pestle 104 mounted on the auxiliary guide bar 72, which pestle faces the swinging plate 52 and cooperates with a stop 106 arranged there, so that in a corresponding lapping movement this pestle 104 stands on the stop 106 and shifts the auxiliary rail to the right, counter to the bias tension force of the spring device 80, so that the auxiliary thread guide 76 is moved to the right in the lengthwise slots 78 relative to the guide bar 46, while the guide bar 46 itself is moved to the left. The stop 106 is adjustable on the swinging plate 52. For this a fluid activated piston/cylinder unit 108 is incorporated into the swinging plate 52, in which the stop 106 is connected to a piston rod 110 which in turn is connected to a piston 112, which is bias-tensioned in base position by means of a pressure spring 114. A feed line 116 serves to supply a pressure medium in order to shift the stop 106 to the right and thereby adjust the starting point and/or the amount of the lapping movement of the auxiliary guide bar 72.

For the drive of the auxiliary guide bar 72 there are still various other possibilities. For example, the stop 106 can be adjusted by a set screw on the swinging plate 52 instead of the piston/cylinder unit 108. It is also possible, however, to assign to the guide bar 72 an auxiliary drive of its own, in which, for example, the piston/cylinder unit 108 is connected to the carrier plate 68 or to the flange 66 and the piston 112 is connected directly to the pestle 104. Instead of the piston/cylinder unit 101 an electrical drive, for example in the form of a step motor, may be used.

The warp knitting machine represented is very well suited for the production of coarse knitted articles with coarse threads of, for example, up to 4800 tex. For example, nets and mats for the most diverse purposes may be produced by such a warp knitting machine. For example, climbing nets for playgrounds, safety nets of the most diverse types, mats and the like, in each case for the most diverse purposes of use.

I claim:

1. Warp knitting machine, with at least one knitting needle bar and at least one guide bar lapping in lengthwise direction with thread guides for the feeding of threads to the knitting needle bars, characterized in that the guide bar has at least one auxiliary guide bar lapping back and forth in the lengthwise direction of the guide bar with at least one auxiliary thread guide which is driven relatively to the guide bar, and the guide bar is constructed as a tubular profile and has inside guides for the auxiliary guide bar.

2. Warp knitting machine according to claim 1, characterized in that the auxiliary guide bar is bias-tensioned into a base position preferably by means of a spring device.

3. Warp knitting machine according to claim 1, characterized in that the auxiliary guide bar is driven by means of a preferably adjustable stop, with which the auxiliary guide bar cooperates during lapping of the guide bar.

4. Warp knitting machine according to claim 1, characterized in that the auxiliary guide bar is driven by an independent drive device.

5. Warp knitting machine according to claim 1, characterized in that the guide bar is connected to a slack of a circulating member driven by a motor that is reversible in its turning direction.

6. Warp knitting machine, with at least one knitting needle bar and at least one guide bar lapping in lengthwise direction with thread guides for the feeding of threads to the knitting needle bars, characterized in that the guide bar has at least one auxiliary guide bar lapping back and forth in the lengthwise direction of the guide bar with at least one auxiliary thread guide which is driven relatively to the guide bar, the auxiliary thread guide is arranged in a displacement plane and the thread guides are also arranged in said displacement plane, and the guide bar is constructed as a tubular profile and has inside guides for the auxiliary guide bar.

7. Warp knitting machine, with at least one knitting needle bar and at least one guide bar lapping in lengthwise direction with thread guides for the feeding of threads to the knitting needle bars, characterized in that the guide bar has at least one auxiliary guide bar lapping back and forth in the lengthwise direction of the guide bar with at least one auxiliary thread guide which is driven relatively to the guide bar, and the auxiliary guide bar is bias-tensioned into a base position preferably by means of a spring device.

8. Warp knitting machine according to claim 7, characterized in that the auxiliary guide bar is driven by means of a preferably adjustable stop, with which the auxiliary guide bar cooperates during lapping of the guide bar.

9. Warp knitting machine according to claim 7, characterized in that the auxiliary guide bar is driven by an independent drive device.

10. Warp knitting machine according to claim 7, characterized in that the guide bar is connected to a slack of a circulating member driven by a motor that is reversible in its turning direction.

11. Warp knitting machine according to claim 7, characterized in that the auxiliary thread guide is arranged in a displacement plane and the threads guides are also arranged in said displacement plane.

12. Warp knitting machine, with at least one knitting needle bar and at least one guide bar lapping in lengthwise direction with thread guides for the feeding of threads to the knitting needle bars, characterized in that the guide bar has at least one auxiliary guide bar lapping back and forth in the lengthwise direction of the guide bar with at least one auxiliary thread guide which is driven relatively to the guide bar, and the auxiliary guide bar is driven by means of a preferably adjustable stop, with which the auxiliary guide bar cooperates during lapping of the guide bar.

13. Warp knitting machine according to claim 12, characterized in that the guide bar is connected to a slack of a circulating member driven by a motor that is reversible in its turning direction.

14. Warp knitting machine according to claim 12, characterized in that the auxiliary thread guide is arranged in a displacement plane and the threads guides are also arranged in said displacement plane.

15. Warp knitting machine, with at least one knitting needle bar and at least one guide bar lapping in lengthwise direction with thread guides for the feeding of threads to the knitting needle bars, characterized in that the guide bar has at least one auxiliary guide bar lapping back and forth in the lengthwise direction of the guide bar with at least one auxiliary thread guide which is driven relatively to the guide bar, and the guide bar is connected to a slack of a circulating member driven by motor that is reversible in its turning direction.

16. Warp knitting machine according to claim 9, characterized in that the motor is connected with the circulating member by means of a reducing gear adjustable in its reduction ratio.

17. Warp knitting machine according to claim 15, characterized in that the auxiliary thread guide is arranged in a displacement plane and the threads guides are also arranged in said displacement plane.

* * * * *